US005224541A

United States Patent [19]

Jennings, Jr.

[11] Patent Number: 5,224,541

[45] Date of Patent: Jul. 6, 1993

[54] USE OF PROFILE CONTROL AGENTS TO ENHANCE WATER DISPOSAL

[75] Inventor: Alfred R. Jennings, Jr., Plano, Tex.

[73] Assignee: Mobil Oil Corporation, Fairfax, Va.

[21] Appl. No.: 864,100

[22] Filed: Apr. 6, 1992

[51] Int. Cl.[5] ..... E21B 33/138; E21B 47/10

[52] U.S. Cl. ..... 166/250; 166/270; 166/294; 405/128; 405/266

[58] Field of Search ..... 166/250, 252, 266, 270, 166/292, 294, 295; 405/128, 266, 52

[56] References Cited

U.S. PATENT DOCUMENTS

| | | | |
|---|---|---|---|
| 3,526,279 | 9/1970 | Colburn | 405/128 X |
| 3,722,593 | 3/1973 | Poettmann | 405/128 |
| 4,085,798 | 4/1978 | Schweitzer et al. | 166/252 |
| 4,787,452 | 11/1988 | Jennings, Jr. | 166/272 |
| 4,790,688 | 12/1988 | Castor | 405/128 |
| 4,828,030 | 5/1989 | Jennings, Jr. | 166/271 |
| 4,899,818 | 2/1990 | Jennings, Jr. et al. | 166/270 |
| 4,907,656 | 3/1990 | Sanchez et al. | 166/270 |
| 4,950,698 | 8/1990 | Shu et al. | 523/130 |
| 4,963,597 | 10/1990 | Shu | 523/130 |
| 5,002,980 | 3/1991 | Phelps et al. | 523/130 |
| 5,065,822 | 11/1991 | Miller et al. | 405/52 X |
| 5,111,886 | 5/1992 | Dovan et al. | 166/300 |
| 5,133,624 | 7/1992 | Cahill | 166/308 |

*Primary Examiner*—George A. Suchfield

*Attorney, Agent, or Firm*—A. J. McKillop; G. W. Hager; C. A. Malone

[57] ABSTRACT

A method for the disposal of waste water in a formation having varying permeability zones therein where a higher permeability zone is first closed to fluid flow via a solidifiable gellable mixture. This mixture forms a solid gel in the higher permeability zone. Afterwards, waste water is injected into a zone of lesser permeability which allows increased amounts of water to be placed into the formation.

8 Claims, 1 Drawing Sheet

USE OF PROFILE CONTROL AGENTS TO ENHANCE WATER DISPOSAL

FIELD OF THE INVENTION

This invention relates to the treatment of formations surrounding hydrocarbon production areas, oil wells, gas wells, or similar hydrocarbon containing formations. It is particularly directed to the disposal of water produced with hydrocarbonaceous fluids.

BACKGROUND OF THE INVENTION

When producing hydrocarbonaceous fluids from an oil well or reservoir, a high volume of water is often produced therewith. The water is subsequently separated from the hydrocarbonaceous fluids. Once the water has been separated out, it often cannot be disposed of readily because of impurities contained in the water along with traces of oil. Therefore, it is necessary to dispose of the water in a manner which is in keeping with accepted environmental standards.

One method which is often used to dispose of waste water produced with hydrocarbonaceous fluids is to pump the water into an underground formation via a well. When this is done, the water generally takes the path of least resistance and enters into a high permeability zone of the formation. When the high permeability has become saturated with the water, it often proceeds from the high permeability zone into an underground area such as abandoned wellbores or an underground aquifer.

It has been previously disclosed to dispose of fines produced with an oil by making a slurry of fines with water. Subsequently, the slurry is pumped into the formation. The formation can then be hydraulically fractured by using the slurry as a frac fluid to increase the permeability of the formation. A method where fines have been used in this manner is disclosed in U.S. Pat. No. 4,828,030, which issued to Jennings, Jr. on May 9, 1989. Another method where fines have been disposed of in conjunction with an enhanced oil recovery process is disclosed in U.S. Pat. No. 4,787,452, which issued to Jennings, Jr. on Nov. 29, 1988. These patents are hereby incorporated by reference. Both of these methods seek to inject formation fines into a high permeability zone of a formation for disposal. Since the high permeability zone can release contaminated liquids into an undesired area, it is necessary to close off the high permeability zone so as to increase the storage of undesired waste in an area near the wellbore.

Therefore, what is needed is a method for closing off a high permeability zone of a formation which has been saturated with contaminated waste water so as to allow the use of an area in close proximity to the wellbore for storage of additional waste water.

SUMMARY

In the practice of this invention, a gellable composition is directed into a high permeability zone of a formation which is penetrated by a wellbore. Once the gellable composition has been in the formation for a time sufficient to form a solid gel, waste water is pumped into a lower permeability zone. By placing the waste water into a lower permeability zone, the lower permeability zone can be used to more effectively store additional contaminated water, while minimizing contamination by unintentional seepage of the waste water into an undesired area.

If desired, waste water can be injected or pumped into the higher permeability zone until such time as the waste water appears in an observation well which is in close proximity to the disposal well. Once the waste water is detected in the observation well, injection or pumping of the waste water into the disposal well can be terminated. Once the injection has ceased, a solidifiable gellable composition or mixture is next injected into the high permeability zone and the steps above are repeated.

It is therefore an object of this invention to prevent waste water contamination of surface streams and tributaries by directing the waste water into an underground formation.

It is another object of this invention to control placement of waste water into an underground formation by selectively closing higher permeability zones in a formation.

It is a further object of this invention to direct waste water into a lower permeability zone so as to more efficiently use an area surrounding a wellbore for the storage of waste water produced from or during the production of hydrocarbonaceous fluids.

PREFERRED EMBODIMENT

Figure 1:
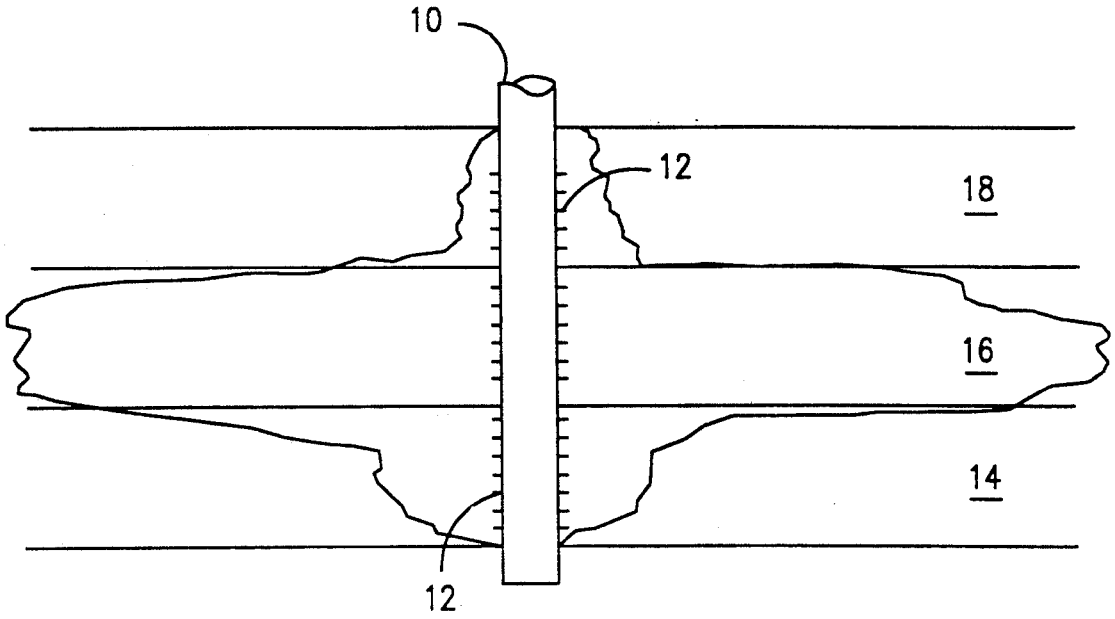
FIG. 1 is a schematic representation of a waste disposal well which depicts how the well is placed within the formation containing zones of varying permeabilities so as to allow the injection of water into a high permeability zone.

In the practice of this invention, referring to FIG. 1, water separated from the hydrocarbonaceous fluids is injected or pumped into disposal well 10. Once the water enters the well, perforations 12 allow the water to enter the various zones of the formation. As is shown in the drawing, substantially all of the waste water enters the high permeability zone 16 via perforations 12. Lesser amounts enter the moderate permeability zone 14 and the low permeability zone 18. As is shown in the drawing, since substantially all of the waste water enters high permeability zone 16, the areas of moderate and low permeability receive very little waste water. As a result, the radial area surrounding the wellbore both below and above the high permeability zone 16 are not effectively utilized to store waste water therein.

Figure 2:
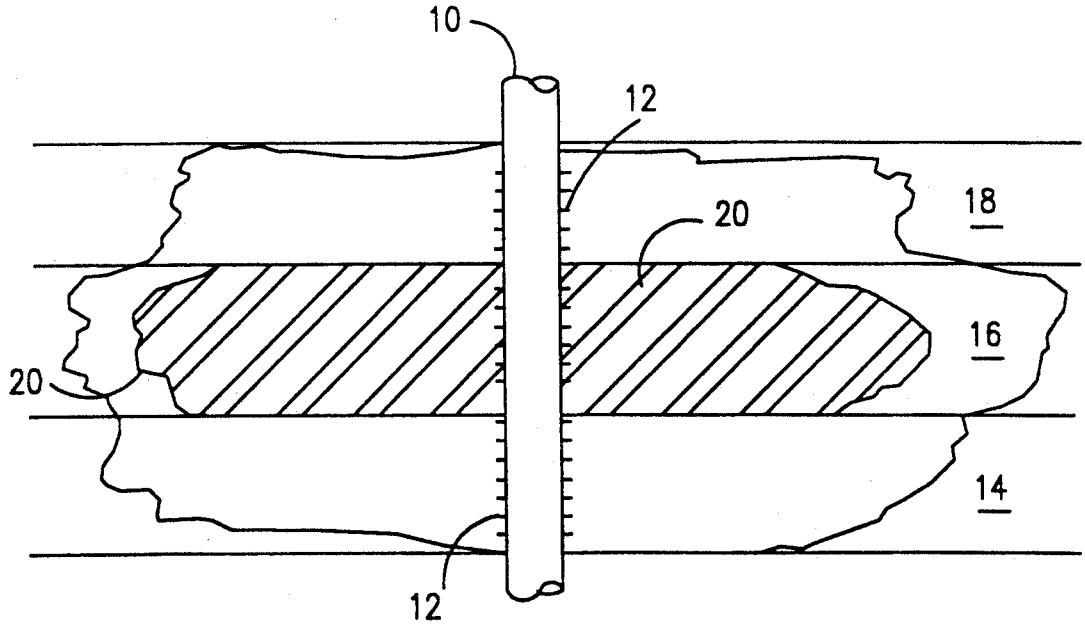
FIG. 2 is a schematic representation of a zone having a higher, an intermediate, and a lower permeability zone therein which shows the high permeability zone with a solid gel formed therein.

In order to correct this situation, referring to FIG. 2, a gellable solidifiable composition or mixture is directed into injection well 10 where upon it enters high permeability zone 16 via perforations 12. The solidifiable gellable mixture is allowed to remain in high permeability zone 16 for a time sufficient to form a solid gel 20. Once the solid gel forms, additional water cannot enter high permeability zone 16. Thereafter, as water is pumped into disposal well 10, it enters moderate or intermediate permeability zone 14 and low permeability zone 18. Since the moderate and low permeability zones are able to contain greater quantities of waste water, the radial area around the wellbore and below and above high permeability zone 16 are able to contain substantially increased amounts of waste water. Pressure related to the injection of the waste water into disposal well 10 will not cause the solid gel to move so waste water is continually injected into the moderate and low permeability zones. As a result, water does not enter into the high permeability zone so as to contaminate fresh water sands, old abandoned wellbores or a fresh water aquifer.

Although not shown, the method can also be used in combination with an observation well located at a desired interval in proximity to disposal well 10. When the observation well is used along with the disposal well, the water can be pumped into high permeability zone 16 until such time as water is observed in the observation well. Once water is in observation well, injection of the waste water into disposal well 10 is ceased. Upon cessation of waste water injection into high permeability zone 16, a solidifiable gellable mixture is injected into high permeability zone 16. The gellable composition which is utilized can be one which selectively enters the high permeability zone since the gel will be a size too large to enter the moderate and low permeability zones of the formation. Once sufficient amounts of the solidifiable gellable mixture has entered high permeability zone 16, injection of the solidifiable gellable mixture into high permeability zone 16 is stopped.

Thereafter, sufficient time is allowed for the solidifiable gellable mixture to form a solid gel in high permeability zone 16. Once the solidifiable material has formed a solid gel, waste water is injected into disposal well 10 whereupon it enters moderate or intermediate permeability zone 14 and low permeability zone 18. In those situations where it is not desired to use a selective gellable mixture, packers can be installed below high permeability zone 16 to allow entry of a gellable mixture therein.

Selective gellable compositions which can be used as discussed above are disclosed in U.S. Pat. No. 5,002,980, which issued to Phelps et al. on Mar. 26, 1991. Another selective gellable mixture which can be used herein is disclosed in U.S. Pat. No. 4,963,597, which issued to Shu on Oct. 16, 1990. Another selective gellable composition which can be used herein is disclosed in U.S. Pat. No. 4,950,698, which issued to Shu et al. on Aug. 31, 1990. These patents are incorporated herein by reference.

Other gellable compositions can also be used herein to close the high permeability zone as will be understood by those skilled in the art. One such gellable composition which can be used herein where the temperature permits is disclosed by Sanchez et al. in U.S. Pat. No. 4,907,656, which issued on Mar. 13, 1990. This patent is hereby incorporated by reference herein.

In those situations where it is not desired to use a production packer, entry of the solidifiable gellable mixture into the high permeability zone can be minimized by using a method as disclosed by Jennings, Jr. et al. in U.S. Pat. No. 4,899,818, which issued on Feb. 13, 1990. This patent is hereby incorporate by reference herein.

Although the present invention has been described with preferred embodiments, it is to be understood that modifications and variations may be resorted to without departing from the spirit and scope of this invention as those skilled in the art will readily understand. Such modifications and variations are considered to be within the purview and scope of the appended claims.

What is claimed is:

1. A method for the disposal of waste water into a formation containing zones of varying permeabilities comprising:

a) directing a solidifiable gellable mixture via a well into a higher permeability zone of said formation which mixture subsequently forms a solid gel sufficient to preclude entry of waste water into said zone; and b) directing thereafter waste water into an intermediate and a low permeability zone of said formation which water is precluded from entering said high permeability zone via said solid gel which results in the formation being loaded with substantially increased amounts of waste water than would be possible when utilizing the higher permeability zone only.

2. The method as recited in claim 1 where prior to step a) waste water is directed into the higher permeability zone until said water breaks through at an observation well distant from and communicating with said well in step a).

3. The method as recited in claim 1 where waste water is directed into the intermediate permeability zone until water breaks through at an observation well distant from and communicating with said well in step a).

4. The method as recited in claim 1 where said waste water results from the production of hydrocarbonaceous fluids from a formation or reservoir.

5. A method for the disposal of waste water into a formation containing zones of varying permeabilities comprising:

a) directing waste water into a higher permeability zone via a disposal well until said water breaks through at an observation well distant from and communicating with the disposal well;

b) directing via a disposal well a solidifiable gellable mixture into a high permeability zone of the formation which mixture subsequently forms a solid gel sufficient to preclude entry of waste water into said zone;

c) directing thereafter waste water into an intermediate and a lower permeability zone of said formation which water is precluded from entering said high permeability zone containing a solid gel until the waste water breaks through from the intermediate permeability zone into said observation well;

d) placing into the intermediate permeability zone a solidifiable gellable mixture which subsequently forms a solid gel sufficient to preclude entry of waste water into said intermediate zone; and e) directing thereafter waste water into a lower permeability zone which water is precluded from entry into said higher permeability zone and the intermediate zone which results in the formation being loaded with substantially increased amounts of waste water than would be possible when utilizing the higher permeability and intermediate zones.

6. A method for the disposal of waste water into a formation containing zones of varying permeability:

a) placing waste water into a higher permeability zone by a disposal well until said water breaks through at an observation well distant from and communicating with said disposal well;

b) directing via said disposal well a solidifiable gellable mixture into said higher permeability zone which mixture subsequently forms a solid gel sufficient to preclude entry of waste water into said zone; and c) directing thereafter waste water into an intermediate and a lower permeability zone of said formation which water is precluded from entering the higher permeability zone containing a solid gel which results in the formation being loaded with substantially increased amounts of waste water than would be possible when utilizing the high permeability zone only.

7. The method as recited in claim 6 where said intermediate zone is loaded with water until said water breaks through at an observation well.

8. The method as recited in claim 6 where the waste water is resultant from production of hydrocarbonaceous fluids.

* * * * *